United States Patent [19]

Sproul et al.

[11] Patent Number: 4,670,172

[45] Date of Patent: Jun. 2, 1987

[54] PROCESS AND KIT FOR WORKING METALS

[75] Inventors: William D. Sproul, Palatine; Roger K. Nibert, Hoffman Estates, both of Ill.

[73] Assignee: Borg-Warner Corporation, Chicago, Ill.

[21] Appl. No.: 717,915

[22] Filed: Mar. 29, 1985

[51] Int. Cl.[4] ..... C10M 173/00

[52] U.S. Cl. ..... 252/49.3; 72/42; 252/49.5; 252/51.5 A; 252/51.5 R

[58] Field of Search ..... 252/49.3, 49.5, 51.5 A, 252/51.5 R, ; 72/42; 409/64

[56] References Cited

U.S. PATENT DOCUMENTS

| | | | |
|---|---|---|---|
| 2,917,160 | 12/1959 | Turinsky | 252/51.5 R |
| 2,990,369 | 6/1961 | Shapiro | 252/49.3 |
| 3,186,946 | 6/1965 | Sluhan | 252/49.3 |
| 3,195,332 | 7/1965 | Ranauto | 72/42 |
| 3,265,620 | 8/1966 | Herman | 252/51.5 R |
| 3,280,029 | 10/1966 | Waldmann | 252/49.5 |
| 3,933,658 | 1/1976 | Beiswanger et al. | 252/31 |
| 4,043,925 | 8/1977 | Felton, Jr. | 252/49.3 |
| 4,169,913 | 10/1979 | Kobayashi et al. | 428/472 |
| 4,172,802 | 10/1979 | Reider | 252/49.3 |
| 4,177,154 | 12/1979 | Chakrabarti | 252/32.5 |
| 4,185,485 | 1/1980 | Schick et al. | 72/42 |
| 4,329,249 | 5/1982 | Forsberg | 252/34.7 |
| 4,428,811 | 1/1984 | Sproul et al. | 204/192 R |
| 4,428,812 | 1/1984 | Sproul | 204/192 R |
| 4,539,125 | 9/1985 | Sato | 252/49.5 |

FOREIGN PATENT DOCUMENTS

| | | |
|---|---|---|
| 2141100 | 4/1970 | Fed. Rep. of Germany . |
| 1959690 | 6/1971 | Fed. Rep. of Germany . |
| 83679 | 8/1974 | Japan . |
| 67733 | 7/1975 | Japan . |
| 142439 | 11/1975 | Japan . |
| 154563 | 12/1980 | Japan . |
| 29670 | 3/1981 | Japan . |
| 39776 | 3/1983 | Japan . |
| 116962 | 7/1982 | Poland . |

OTHER PUBLICATIONS

Chemical Abstracts, vol. 77; 65316s; 1972.

Phosphoryl Tris(Diethanolamide)(DAP)-A New Additive for Water-Based and Ethylene-Glycol-Based Hydraulic Fluids and Lubricants, L. Tokarzewski, et al., Wear, No. 50 (1978), p. 365-369.

C.A. 76, 102886e (1972), Uber die Abscheidung von Hartstoffschichten, Prof. Dr. R. Keiffer, et al., Jan.-Feb. 1972 p. 128.

C.A. 99, 179673r (1983).

C.A. 99, 57373x (1983).

C.A. 75, 66737a (1971).

C.A. 99, 75007k (1983).

C.A. 95, 11159w (1981).

C.A. 77, 65316s (1972).

C.A. 84, 183347v (1976).

C.A. 95, 154798q (1981).

C.A. 82, 89141k (1975).

C.A. 84, 94226n (1976).

*Primary Examiner*—Jacqueline V. Howard

*Attorney, Agent, or Firm*—Emily A. Richeson

[57] ABSTRACT

A kit and process are provided for working metals, said kit comprising a metal nitride and/or metal carbonitride coated metal working tool and a water soluble metal working fluid, said fluid including a relatively large alkoxylated amine, an alkanol amine and an acid-derived compound selected from the group consisting of organic acids, inorganic acids, and salts thereof, and said process comprising contacting a metal workpiece with said metal working tool and said fluid to effectuate working of said metal.

17 Claims, No Drawings

PROCESS AND KIT FOR WORKING METALS

BACKGROUND OF THE INVENTION

The present invention relates to a process and kit for working metal, such as drilling, milling, tapping, grinding, boring, turning and cutting metal sheet, tube, slab or other metal stock.

Metal nitrides, carbides and carbonitrides are known to exhibit antiwear properties when utilized on the working surfaces of metal working tools. U.S. Pat. No. 4,169,913 to Kobayashi and Chemical Abstracts (CA) 76:102886e disclose coatings of titanium (Ti), hafnium (Hf) and zirconium (Zr) carbides, nitrides and carbonitrides as exhibiting improved antiwear properties. Improved wear resistance and fatigue strength are also reported by CA 99:75007k for titanium nitride coated high-speed tool steel, and by CA 99:179673r for tools with titanium carbide (TiC) and titanium nitride (TiN) coatings. Extension of service life of cutting and cold forming tools coated with titanium carbide, titanium nitride, titanium carbonitride, chromium carbide and aluminum oxide layers deposited by chemical vapor deposition is reported by CA 99:57373x. Nitrides or carbonitrides of metals of the titanium, vanadium and chromium (Cr) groups (Groups IVB-VIB of the Periodic Table) are also reported by CA 75:66737a and CA 95:11159w as being wear-protecting. Coatings of carbides, nitrides, carbonitrides and/or borides of Ti, Zr, Hf, vanadium, niobium, and/or tantalum (Ta), are disclosed by Ca 77:65316s.

Metal nitrides, carbides and carbonitrides may be deposited on metal surfaces by a variety of known techniques. U.S. Pat. No. 4,428,811, U.S. Pat. No. 4,428,812, CA 84:183347v and CA 84:94226n relate to processes for depositing TiN and other metal nitrides onto substrates by sputtering. Processes for coating surfaces by chemical vapor deposition are disclosed by CA 82:89141k and CA 95:154798q.

Similarly, a variety of water-based metal-working fluid compositions are known in the art. U.S. Pat. No. 2,917,160 to Turinsky relates to a water-soluble lubricating composition of an ethoxylated amine and a salt-forming acid, such as phosphoric acid or lactic acid. According to Turinsky, this lubricant composition should have a pH below 8, and is useful in water emulsions in a ratio of 1 part amine to 3 parts water. A similar aqueous cutting fluid is disclosed by U.S. Pat. No. 3,186,946 to Sluhan. This cutting fluid consists of a tertiary ethoxylated amine in aqueous solution with boric acid to form an amine salt.

Other water-based metal-working compositions are known in the art. U.S. Pat. No. 3,195,332 to Ranauto discloses an aqueous lubricant composition which includes a polyoxyethylene imidazoline. A corrosion inhibitor, such as sodium nitrite, triethanol amine or morpholine may also be included. U.S. Pat. No. 3,265,620 to Heiman discloses an aqueous metal-working coolant comprising an ethanol amine, an alkali metal nitrite, and an aryl triazole which is at least one of benzotriazole and 4-nitrobenzotriazole. Heiman discloses that such compositions preferably should include a chelating agent, such as an amino polycarboxylic acid. Another water-based lubricant composition is disclosed by U.S. Pat. No. 2,990,369 to Shapiro.

A metal-working composition which may be emulsified in water is disclosed by U.S. Pat. No. 4,185,485 to Schick et al. This composition includes an ester formed by reacting an alkenylsuccinic anhydride or acid with a hydroxy containing tertiary alkylamine, such as triethanol amine, or a hydroxy polyether amine. This composition may also contain a $C_2$–$C_{10}$ monocarboxylic acid. When the reaction product is formed from an alkenylsuccinic anhydride or acid reacted with a hydroxy polyether amine, the composition may contain a rosin soap in addition to or instead of the monocarboxylic acid.

U.S. Pat. No 3,280,029 to Waldmann relates to a composition for improved lubricating oils and water-in-oil emulsions comprising alkyl amino monoalkanols, such as monoethyl aminoethanol, diethyl amino ethanol and diethyl amino ethoxy ethanol. U.S. Pat. No. 4,043,925 to Felton relates to a water-based metal-forming composition comprising a block copolymer with a central portion of polypropylene oxide with polyethylene oxide at each end, a sulfochlorinated fatty acid, an alkoxylated 1,5-aza pentane, and potassium hydroxide. U.S. Pat. No. 4,329,249 to Forsberg relates to the formation of nitrogen-containing phosphorous-free carboxylic acid derivatives. These derivatives may be formed by reacting a carboxylic acid acylating agent with an alkylmonoalkoxy tertiary amine, and are useful for the incorporation of oil-soluble, water-insoluble functional additives into water-based functional fluids, such as water-based hydraulic fluids.

Other metal-working fluids, related in certain aspects to the metal-working fluid useful in the present invention, are disclosed by U.S. Pat. Nos. 4,172,802 to Rieder, 4,177,154 to Chakrabarti, and 3,933,658 to Beiswanger et al. Further, a phosphoral tris(diethanolamide) additive is disclosed for water-based and ethylene-glycol based hydraulic fluids and lubricants in Wear, 50 (1978) 365–369, Ludomir, Tokarzewski, Zakrzewski, Wachowicz and Szczepaniak. Another phosphorus based metal-working composition is disclosed in Polish Patent Document No. 116,962 to Szczepaniak et al.

Although metal working fluids are usually employed to increase the effective tool life, some metal working fluids have the disadvantage of reacting with metal nitrides or carbonitrides, so that they actually decrease the useful life of the coated tools with which they come in contact. As coated tools are relatively expensive, even if a metal working fluid does not degrade nitride or carbonitride coatings it is advantageous to utilize a metal working fluid which exhibits superior tool life extension.

SUMMARY OF THE INVENTION

In general, the present invention is a kit and process for working metal, wherein the metal working kit comprises a metal working tool and a water soluble metal working fluid, and the process comprises contacting a metal workpiece with the tool and the metal working fluid. The metal working tool has disposed thereon an antiwear coating which includes at least one of a metal nitride and a metal carbonitride. The water-soluble metal-working fluid is one which includes a relatively large alkoxylated amine, an alkanol amine and an acid-derived compound, wherein the large alkoxylated amine is generally described by the formula:

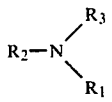

Consistent with this formula, $R_1$ is selected from the group consisting of hydrogen, hydrocarbyl moieties, alkoxy moieties and polyalkoxy moieties, $R_2$ is selected from the group consisting of $C_7$ and larger hydrocarbyl moieties, and $R_3$ is selected from the group consisting of alkoxy moieties and polyalkoxy moieties.

The alkanol amine may generally be described by the formula:

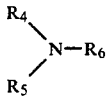

$R_4$ is selected from the group consistent of hydrogen, $C_1$–$C_6$ hydrocarbyl moieties, and monomeric and polymeric alkoxy moieties consisting essentially of alkoxy units selected from the group consisting of ethoxy, 2-propoxy, 2-butoxy and mixtures thereof. $R_5$ is selected from the group consisting of $C_1$–$C_6$ hydrocarbyl moieties, and monomeric and polymeric alkoxy moieties consisting essentially of alkoxy units selected from the group consisting of ethoxy, 2-propoxy, 2-butoxy and mixtures thereof. $R_6$ is selected from the group consisting of monomeric and polymeric alkoxy moieties consisting essentially of alkoxy units selected from the group consisting of ethoxy, 2-propoxy, 2-butoxy and mixtures thereof. $R_4$, $R_5$ and $R_6$ are additionally selected so that the alkanol amine contains a total of 6 or fewer alkoxy units.

The acid-derived compound included in the present invention is selected from the group consisting of inorganic acids, organic acids, and salts thereof.

Preferably, the metal of the antiwear coating is selected from the group consisting of Ti, Hf, Zr, Ta and Cr, and more preferably is selected from Ti, Hf and Zr, with Ti being most preferred.

DETAILED DESCRIPTION OF THE INVENTION

The present invention is a process and kit for working metal. This kit and process may be used in a variety of metal working operations, such as drilling, cutting, boring and grinding, as well as other operations. Further, the kit and process of the present invention may be used in conjunction with a variety of different metal materials, such as stainless steel, high carbon steel, alloys and other materials.

The kit comprises a metal working tool and a water soluble metal working fluid, both of which are described below. The process of the present invention comprises contacting a metal workpiece with the tool and the water soluble metal working fluid to effectuate working of the metal.

The metal workpiece may be contacted with the metal working tool by means known in the art. Such means may include punch presses, lathes, drill presses and milling machines wherein the tool and/or the workpiece is set in motion so as to alter the configuration of the workpiece. Similarly, the workpiece may be contacted with the metal working fluid using known means. Although the fluid may be applied to the workpiece before it undergoes working by the tool, the fluid is usually applied by flooding appropriate areas of the workpiece with the fluid while the tool and workpiece are in active contact.

The metal working tool of the process and kit of the present invention may be any tool appropriate for the intended metal working operation. Such tools may include drills, taps, inserts and end mills. Similarly, the material from which the tool is constructed is not critical to the present invention, but will usually be a high speed tool steel or alloy, depending upon the metal working operation for which the tool is intended.

The metal working tool of the present invention is one which has an antiwear coating. This coating includes at least one of a metal nitride and a metal carbonitride, and may contain minor amounts of other materials, such as oxygen. This coating usually at least will extend over that part of the tool which is contacted with the metal workpiece, and may extend over other parts of the tool as well.

Preferably, the metal of the nitride or carbonitride is a transition metal selected from the group consisting of Ti, Hf, Zr, Ta and Cr. More preferably the metal is selected from the group consisting of Ti, Hf and Zr, with Ti being most preferred.

Although the coating may comprise a nitride, a carbonitride or a combination thereof, coatings with at least some metal nitride are preferred. Coatings which are substantially all nitride are most preferred.

The means by which the coating is applied to the tool are not critical to the present invention, but may be any suitable technique, such as reactive sputtering and chemical vapor deposition. Similarly, the thickness of the coating is not critical to the present invention. However, in most applications the coating will be about 1 to about 5 μm (micrometers) thick.

The metal working fluid useful in the kit and process of the present invention is a water-soluble, metal-working composition comprising a relatively large alkoxylated amine, an alkanol amine and an acid-derived compound. According to the invention, the alkoxylated amine is a relatively large amine which may be generally described by the formula:

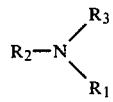

$R_2$ is a relatively large hydrocarbon group selected from the group consisting $C_7$ and larger hydrocarbyl moieties. These hydrocarbyl moieties are generally alkyl or alkenyl in character, but may be aryl moieties, such as benzyl, and alkyl phenyls, such as nonyl phenyl. However, alkyl and alkenyl moieties are preferred. Polyalkoxy groups are not included. About $C_{12}$ to about $C_{20}$ hydrocarbyl moieties, such as stearyl, oleyl, palmyl, linoleyl, soya, lauryl, myristyl and tallow, are more preferred. Stearyl, oleyl, soya, coco and tallow moieties are most preferred.

$R_1$ is selected from the group consisting of hydrogen, hydrocarbyl moieties, alkoxy moieties and polyalkoxy moieties. The hydrocarbyl moieties may be aryl, alkyl or alkenyl in character, such as phenyl, stearyl, oleyl, soya, coco and tallow. Alkyl or alkenyl groups are preferred. Although $R_1$ may be selected independent of $R_2$, when $R_1$ is hydrocarbyl it is preferred that $R_1$ be the same as $R_2$ due to the relative cost efficiency of preparing the alkoxylated amine when, instead of being different hydrocarbyl moieties, both $R_1$ and $R_2$ are the same. Preferably, however, $R_1$ is an alkoxy or a polyalkoxy moiety, consistent with those defined for $R_3$.

$R_3$ may only be selected from the group consisting of alkoxy and polyalkoxy moieties. Preferably, these alkoxy and polyalkoxy moieties consist essentially of alkoxy units generally described by the following formula. As will be understood by those skilled in the art, the oxygen of alkoxy moieties and the terminal oxygen of polyalkoxy moieties is bonded to hydrogen, not shown in the above formula, to form a terminal hydroxy group.

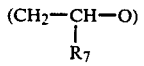

$R_7$ is selected from the group consisting of hydrogen and $C_1$–$C_{28}$ hydrocarbyl moieties, such as alkyl groups like methyl, ethyl and propyl. More preferably, $R_7$ is hydrogen, methyl or ethyl, so that the alkoxy unit is an ethoxy, 2-propoxy or 2-butoxy unit, respectively. Ethoxy and propoxy units, wherein $R_7$ is hydrogen or methyl, respectively, are even more preferred. Although $R_3$ may be a polyalkoxy moiety consisting of a mixture of different alkoxy units, such as a mixture of ethoxy units and propoxy units, it is more preferred that $R_3$ be homogenous. Hydroxy ethyl and homogenous polyethoxy moieties are most preferred.

Although $R_1$ may be selected independently from $R_3$, when $R_1$ is an alkoxy or polyalkoxy moiety, it is preferred that $R_1$ consist essentially of at least some of the same alkoxy units as $R_3$ in order to simplify preparation of the large alkoxylated amine. For example, when $R_3$ is a polyalkoxy moiety of mixed ethoxy and propoxy units, it is preferred that $R_1$ be hydroxy ethyl, hydroxy propyl, polyethoxy, polypropoxy or a polyalkoxy moiety of mixed ethoxy and propoxy units. Similarly, when $R_3$ is a polyethoxy moiety, it is preferred that $R_1$ be hydroxy ethyl, polyethoxy or a mixed polyalkoxy moiety of ethoxy units and other alkoxy units. Most preferably, however, both $R_1$ and $R_3$ consist essentially of the same kind of alkoxy units.

In the preferred embodiment $R_1$ and $R_3$ are chosen such that the total number of alkoxy units in the large alkoxylated amine is equal to 2 to about 35. For example, the total number of alkoxy groups may be equal to 2 when each of $R_1$ and $R_3$ is hydroxy ethyl, or when $R_3$ is a polyethoxy moiety consisting of 2 ethoxy units and $R_1$ is hydrogen or a hydrocarbyl moiety such as tallow. More preferably, the total number of alkoxy units in said large alkoxylated amine is equal to about 5 to about 20, such as where $R_3$ is a polyethoxy moiety consisting of three ethoxy units, and $R_1$ is a polyethoxy moiety consisting of two ethoxy units. Relatively large alkoxylated amines consistent with the preferred embodiment of metal working fluid useful in practicing the invention are commercially available from the Borg-Warner Corporation under the trademark "PEGAMEEN".

The alkanol amine is a relatively small amine, and may be generally described by the formula:

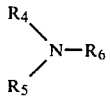

$R_4$ is selected from the group consisting of hydrogen, $C_1$–$C_6$ hydrocarbyl moieties such as methyl, phenyl, ethyl, propyl and butyl, and monomeric and polymeric alkoxy moieties. When $R_4$ is a monomeric or polymeric alkoxy moiety, the alkoxy moiety consists essentially of alkoxy units selected from the group consisting of ethoxy, 2-propoxy, 2-butoxy and mixtures thereof. For example, when $R_4$ is a monomeric alkoxy moiety, $R_4$ is selected from the group consisting of hydroxy ethyl($HO—CH_2CH_2—$), 2-hydroxy propyl($CH_3CH(OH)CH_2—$), and 2-hydroxy butyl($CH_3CH_2CH(OH)CH_2—$) moieties. Although $R_4$ may be a polymeric alkoxy moiety, such as polyethoxy($HOCH_2CH_2OCH_2—CH_2—$) or polypropoxy ($CH_3CH(OH)—CH_2OCH(CH_3)CH_2—$), $R_4$ preferably is a simple alkoxy moiety, such as hydroxy ethyl or 2-hydroxy propyl, a simple hydrocarbyl such as methyl, ethyl, or hydrogen, such as in dimethyl ethanol amine, N-phenyl ethanol amine, and N,N-diethyl ethanol amine. Hydroxy ethyl and hydrogen are most preferred, such as when the alkanol amine is triethanol amine, diethanol amine or N-methyl ethanol amine.

$R_5$ may be selected from the group consisting of $C_1$–$C_6$ hydrocarbyl moieties, as discussed above for $R_4$, and monomeric and polymeric alkoxy moieties which consist essentially of alkoxy units selected from the group consisting of ethoxy, 2-propoxy, 2-butoxy and mixtures thereof, as discussed above for $R_4$. However, unlike $R_4$, $R_5$ may not be hydrogen. Consequently, although the alkanol amine may be a secondary or tertiary amine, the alkanol amine may not be a primary amine. In the embodiment which is most preferred, $R_5$ is methyl, as in N-methyl ethanol amine or dimethyl ethanol amine, or hydroxy ethyl, as in diethanol amine or triethanol amine.

$R_6$ may be a monomeric or polymeric alkoxy moiety consisting essentially of alkoxy units selected from the group consisting of ethoxy, 2-propoxy, 2-butoxy, and mixtures thereof, as discussed above for $R_4$. Preferably, $R_6$ is hydroxy ethyl or 2-hydroxy propyl. Hydroxy ethyl is more preferred. Triethanol amine, N-methyl ethanol amine and mixtures thereof are most preferred.

It should further be noted that although each of $R_4$, $R_5$ and $R_6$ may be a polymeric alkoxy group, the alkanol amine may contain no more than a total of 6 alkoxy units. However, fewer than 6 alkoxy units are preferred, such as in triethanol amine, diethanol amine and N-methyl ethanol amine, wherein the total number of alkoxy units is equal to or less than 3.

The metal working fluid useful in the present invention also contains an acid-derived compound. This acid-derived compound may be an organic acid, an inorganic acid or a salt derived from an organic or inorganic acid by the replacement of an acidic hydrogen by another appropriate cation. Preferred organic acid-derived compounds include acetic acid, propionic acid, butyric acid, formic acid, oxalic acid, succinic acid, glutaric acid, adipic acid, pimelic acid, benzoic acid, suberic acid, azelaic acid, para-toluene sulfonic acid, sebacic acid, and amino acids such as alanine, leucine, phenylalanine, glycine, tyrosine, serine, aspartic acid and glutamic acid.

In the embodiment which is most preferred, the acid-derived compound is an inorganic acid, with phosphoric acid, nitric acid and sulfuric acid being preferred. Boric acid is not preferred. Phosphoric acid is most preferred.

In an alternative embodiment which is less preferred than those discussed above, the acid-derived compound may be a salt of an organic or inorganic acid, and preferably is a salt of the preferred acids discussed above. When the acid-derived compound is a salt, it is preferred that the acid-derived compound be a Group VIII metal, alkaline metal, alkaline earth metal, nitrate, sulfate, phosphate or amine salt. Examples of salts consistent with this embodiment include iron phosphates, ammonium sulfates and sodium nitrates.

It has been found that a metal working fluid may be formulated according to the above description which, instead of being deleterious to nitride and carbonitride coatings, may exhibit excellent cooling, high lubricity, and extreme-pressure properties when combined with nitride or carbonitride coated tools. Some embodiments, such where the fluid contains N-methyl ethanol amine as some or all of the alkanol amine component, may also exhibit a lowered susceptibility to the growth of mold and bacteria, and to the development of rust on the workpiece and equipment.

The ratio of the ingredients in the fluid for optimum performance in a particular application, such as extreme-pressure environments, can be adjusted as needed. It is preferred, however, that the ratio by weight of the alkanol amine to the relatively large alkoxylated amine be about 20:1 to about 0.05:1. More preferably, however, the ratio by weight of the alkanol amine to the large alkoxylated amine is about 10:1 to about 0.1:1, with a ratio of about 7:1 to about 0.5:1 being most preferred. When the ratio of the alkanol amine to the relatively large alkoxylated amine is about 20:1 to about 0.05:1, it is preferred that the ratio by weight of the acid-derived compound to the large alkoxylated amine be about 3:1 to about 0.01:1. Ratios of acid-derived compound to large alkoxylated amine of about 1.5:1 to about 0.1:1, however, are more preferred.

Due to space and weight considerations, the fluid usually is stored and shipped in a relatively concentrated form, usually as an aqueous solution which contains 10–60% by weight, and preferably 20–50% by weight, of the relatively large alkoxylated amine, the alkanol amine and the acid-derived compound combined. Due to the fact that a significant portion of the cost of a lubricating fluid generally is for the "active" components rather than the carrier medium, e.g. water or oil, it is generally preferred that the amount of "active" components in a lubricant or coolant be as low as practically possible when the metal working fluid is used. In the preferred embodiment, the metal working fluid is utilized as an aqueous solution which includes at least 85% by weight water, based on the total weight of the solution, and about 0.1 to 15% by weight of the combined large alkoxylated amine, alkanol amine and the acid-derived compound, although, as is known to those skilled in the art, the appropriate concentration will vary depending on the application. More preferably, however, the large alkoxylated amine, the alkanol amine and the acid-derived compound together constitute about 0.5 to about 10% by weight of the solution, with about 0.5 to 5% being most preferred.

It is further preferred that the pH of the metal working fluid be equal to about 7.5 to about 10.5 in order to minimize the corrosive effects of the composition on the workpiece; pH's in the range of about 8 to about 9.5 are more preferred. Consistent with the invention, pH's in the preferred ranges may be attained by adjusting the proportions of the various components to each other, and/or by adding other components, such as acids or bases, to maintain the proper pH balance. Other components may also be added to assist in solubilizing the composition in water, although these are not usually necessary. Other known additives, such as biocides, dyes, perfumes, antifoam compounds, crystal growth modifiers, scale inhibitors and chelating agents for hard water use may also be included.

SPECIFIC EMBODIMENTS

Reference is made to the following examples, which are provided to illustrate various aspects of the invention by embodying the invention or by providing a basis for comparison.

In these examples, Cim Cool 400 is a proprietary synthetic metal-working concentrate, for heavy machinery and grinding, of Cincinnati Milacron; Trim RD 2-205 is a proprietary metal-working concentrate available from Master Chemical Corp.; True Sol 850 and True Sol 950EP are proprietary soluble oil concentrates available from Cutting and Grinding Fluids, Inc., Rockford, Ill. "BWC Synthetic" indicates a fluid which is 0.4 wt% PEGAMEEN T-7, 2.0 wt% triethanol amine and 0.34 wt% $H_3PO_4$ from an 85 wt% phosphoric acid aqueous solution. "PEGAMEEN" is a Trademark of Borg-Warner Chemicals, Inc. used in conjunction with amine compounds corresponding to relatively large alkoxylated amines useful in the present invention, according to the general formula discussed above, wherein $R_1$ is an alkoxy or polyalkoxy moiety and $R_3$ is hydrogen, an alkoxy or a polyalkoxy moiety. The numerical portion of the PEGAMEEN designation, such as T-7, T-15 and T-25, indicates the average value of the total number of alkoxy units in the large amine compound. Consequently, T-7 indicates an average value of 7. In the examples presented herein, $R_2$ of the large alkoxylated amine is a tallow moiety.

COMPARATIVE EXAMPLES C1, C3–C7

EXAMPLE 2

Drill tests were conducted to assess the performance of metal nitride coated drills in conjunction with metal working fluids. Drills used for this purpose were ¼ in. drills of M-7 high speed steel (containing 1.75–2.25 wt% V, 1.4–2.1% W, 3.5–4.0% Cr, 8.2–9.2% Mo, 0.97–1.05% C, 0.15–0.40% Mn, and 0.20–0.55% Si). The drills had been sputter coated to a coating thickness of about 2.0 um with TiN. The workpiece was 4130 alloy steel hardened to 235 BHN (Brinell Hardness Number). Cutting speed was 1150 RPM with a feed of 0.0084 inches/revolution. The depth of the cut was 0.5 inches. Failure was considered to be when the end of the drill broke.

Comparative Example C1 was performed using a dry drill. Example 2 embodies the present invention. Comparative Examples C3–C8 involve the use of various metal working fluids, but do not embody the invention. The results of testing for these examples are indicated below in Table I.

For all examples, the performance of the metal working fluids with uncoated drills is indicated in Table I for the purposes of comparison. The improvement for each example is calculated based on the performance of the dry, uncoated drill. "Dilution" in Table I is the parts by weight of deionized water to one part of the metal working fluid. Hyphens in the table indicate the category is inappropriate or that data was unavailable. The average number of holes drilled indicated in the table below represents the average of at least 6 runs for each example.

TABLE I

| | | | TiN Coated Drills | | Uncoated Drills | |
|---|---|---|---|---|---|---|
| Ex. | Metal Working Fluid | Dilution | Avg. # Holes | Improvement | Avg. # Holes | Improvement |
| C1 | — | — | 150 | 50X | 3 | — |
| 2 | BWC Synthetic | 36:1 | 491 | 164X | 70 | 23X |
| C3 | Trim RD 2-205 | 10:1 | 306 | 100X | 6 | 2X |
| C4 | True Sol 850 | 20:1 | 7 | 2X | 3 | 1X |
| C5 | True Sol 850 | 10:1 | 15 | 5X | — | — |
| C6 | True Sol 950EP | 20:1 | 16 | 5X | — | — |
| C7 | CimCool 400 | 20:1 | 277 | 92X | 4 | 1X |
| C8 | Deionized $H_2O$ | — | 13 | 4X | — | — |

It will be understood that various changes and modifications may be made in the embodiments outlined above without departing from the spirit of the invention, which includes all equivalents and modifications thereof and is limited only by the following claims.

We claim:

1. A process for working metal comprising contacting a metal workpiece with a metal working tool and a water soluble metal working fluid, said tool having an antiwear coating disposed thereon which includes at least one of a metal nitride and a metal carbonitride, and said metal working fluid includes:

(a) a first amine generally described by the formula:

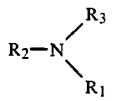

wherein:

$R_1$ is selected from the group consisting of hydrogen, hydrocarbyl moieties, alkoxy moieties and polyalkoxy moieties;

$R_2$ is selected from the group consisting of $C_7$ to about $C_{20}$ hydrocarbyl moieties;

$R_3$ is selected from the group consisting of alkoxy moieties and polyalkoxy moieties;

(b) a second amine described by the formula:

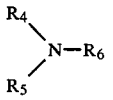

wherein:

$R_4$ is selected from the group consisting of (i) hydrogen, (ii) $C_1$–$C_6$ hydrocarbyl moieties and (iii) monomeric and polymeric alkoxy moieties consisting essentially of alkoxy units selected from the group consisting of ethoxy, 2-propoxy, 2-butoxy and mixtures thereof;

$R_5$ is selected from the group consisting of (i) $C_1$–$C_6$ hydrocarbyl moieties and (ii) monomeric and polymeric alkoxy moieties consisting essentially of alkoxy units selected from the group consisting of ethoxy, 2-propoxy, 2-butoxy and mixtures thereof;

$R_6$ is selected from the group consisting of (i) monomeric and polymeric alkoxy moieties consisting essentially of alkoxy units selected from the group consisting of ethoxy, 2-propoxy, 2-butoxy and mixtures thereof;

such that said second amine contains a total of 6 or fewer alkoxy units;

(c) an acid-derived compound selected from the group consisting of organic acids, inorganic acids, and salts thereof;

wherein the ratio by weight of the second amine to the first amine is about 20:1 to about 0.05:1 and the ratio by weight of the acid-derived compound to the first amine is about 3:1 to about 0.01:1.

2. The process of claim 1 wherein said metal included in said antiwear coating is a transition metal selected from a group consisting of Ti, Hf, Zr, Ta, Cr.

3. The process of claim 2 wherein said metal is selected from the group consisting of Ti, Hf and Zr.

4. The process of claim 3 wherein said metal is Ti.

5. The process of claim 1 wherein said antiwear coating includes a metal nitride.

6. The process of claim 1 wherein $R_1$ and $R_3$ are independently selected from the group consisting of monomeric and polymeric alkoxy moieties consisting essentially of alkoxy units or mixtures of alkoxy units generally described by the formula:

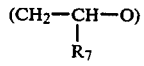

wherein:

$R_7$ is selected from the group consisting of hydrogen, methyl and ethyl moieties;

$R_1$ and $R_3$ are being selected such that the total number of alkoxy units in said large alkoxylated amine is equal to 2 to about 35.

7. The process of claim 1 wherein $R_2$ is selected from the group consisting of about $C_{12}$ to about $C_{20}$ hydrocarbyl moieties.

8. The process of claim 1 wherein $R_5$ is selected from the group consisting of methyl, hydroxy ethyl and hydroxy propyl moieties, and $R_4$ is independently selected from the same group as $R_5$ additionally including hydrogen.

9. The process of claim 8 wherein $R_6$ is hydroxy ethyl.

10. The process of claim 1 wherein said acid-derived compound is selected from the group consisting of $H_3PO_4$, $H_2SO_4$, $HNO_3$, acetic, formic, propionic, oxalic, succinic, glutaric, adipic, pimelic, benzoic acid, suberic, azelaic, paratoluene sulfonic, sebacic, and amino acids.

11. The process of claim 1 wherein the acid-derived compound is a salt selected from the group consisting of Group VIII metal, alkali metal, alkaline earth metal, nitrate, sulfate, phosphate and amine salts.

12. The process of claim 1 wherein the ratio by weight of the second amine to the first amine is about 10:1 to about 0.1:1.

13. The process of claim 1 wherein the ratio by weight of said acid-derived compound to said first amine is about 1.5:1 to about 0.1:1.

14. The process of claim 1 wherein said first amine, said second amine and said acid-derived compound together constitute about 0.1–15% by weight of an aqueous solution.

15. The process of claim 13 wherein said metal working fluid has a pH equal to about 7.5 to about 10.5.

16. The process of claim 15 wherein said metal working fluid has a pH equal to about 8 to about 9.5.

17. A metal working kit comprising a metal working tool and a water soluble metal working fluid, said tool having disposed thereon an antiwear coating which includes at least one of a metal nitride and a metal carbonitride, and wherein said metal working fluid includes:

(a) a first amine described by the formula:

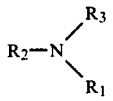

wherein:

$R_1$ is selected from the group consisting of hydrogen, hydrocarbyl moieties, alkoxy moieties and polyalkoxy moieties;

$R_2$ is selected from the group consisting of $C_7$ to about $C_{20}$ hydrocarbyl moieties;

$R_3$ is selected from the group consisting of alkoxy moieties and polyalkoxy moieties;

(b) a second amine generally described by the formula:

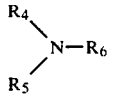

wherein:

$R_4$ is selected from the group consisting of (i) hydrogen, (ii) $C_1$–$C_6$ hydrocarbyl moieties and (iii) monomeric and polymeric alkoxy moieties consisting essentially of alkoxy units selected from the group consisting of ethoxy, 2-propoxy, 2-butoxy and mixtures therof;

$R_5$ is selected from the group consisting of (i) $C_1$–$C_6$ hydrocarbyl moieties and (ii) monomeric and polymeric alkoxy moieties consisting essentially of alkoxy units selected from the group consisting of ethoxy, 2-propoxy, 2-butoxy and mixtures thereof;

$R_6$ is selected from the group consisting of (i) monomeric and polymeric alkoxy moieties consisting essentially of alkoxy units selected from the group consisting of ethoxy, 2-propoxy, 2-butoxy and mixtures thereof;

such that said second amine contains a total of 6 or fewer alkoxy units;

(c) an acid-derived compound selected from the group consisting of organic acids, inorganic acids, and salts thereof;

wherein the ratio by weight of the second amine to the first amine is about 20:1 to about 0.05:1 and the ratio by weight of the acid-derived compound to the first amine is about 3:1 to about 0.01:1.

* * * * *